United States Patent [19]

Alexander et al.

[11] Patent Number: 4,716,695

[45] Date of Patent: Jan. 5, 1988

[54] STEEL FRAMING SYSTEM FOR MULTI-STORY BUILDINGS

[76] Inventors: Theodore G. Alexander, 5136 N. 31st Pl., #644, Phoenix, Ariz. 85016; Claude V. Baker, 512 W. Stella La., Phoenix, Ariz. 85013; Robert Jepson, 6737 W. Union Hills Dr., Peoria, Ariz. 85345

[21] Appl. No.: 752,815

[22] Filed: Jul. 8, 1985

[51] Int. Cl.[4] ..... E02H 9/02

[52] U.S. Cl. ..... 52/167; 52/272; 52/721; 52/729; 52/696

[58] Field of Search ..... 52/167, 729, 236.3, 52/236.8, 334, 241, 250, 272, 273, 637, 638, 640, 643, 648, 721, 726, 251, 351, 696

[56] References Cited

U.S. PATENT DOCUMENTS

| | | | |
|---|---|---|---|
| 1,101,983 | 6/1914 | Barbour | 52/236.3 |
| 1,893,636 | 1/1933 | Ridgway | 52/272 |
| 2,284,923 | 6/1942 | Schick | 52/250 X |
| 2,987,855 | 6/1961 | Singleton et al. | 52/334 |
| 3,305,993 | 2/1967 | Nelsson | 52/241 X |
| 3,736,716 | 6/1973 | Nishimura | 52/334 |
| 3,748,794 | 7/1973 | Lorenzi et al. | 52/236.3 |
| 4,335,557 | 6/1982 | Morton | 52/167 X |

FOREIGN PATENT DOCUMENTS

| | | | |
|---|---|---|---|
| 2116578 | 12/1972 | Fed. Rep. of Germany | 52/241 |

*Primary Examiner*—John E. Murtagh
*Assistant Examiner*—Andrew Joseph Rudy
*Attorney, Agent, or Firm*—William H. Drummond

[57] ABSTRACT

A multi-story building structure in which steel elements, secured together in steel-to-steel contact form the bearing walls and transmit the entire static and seismic loads of the walls and floors thereabove.

1 Claim, 4 Drawing Figures

STEEL FRAMING SYSTEM FOR MULTI-STORY BUILDINGS

BACKGROUND OF THE INVENTION

1. Field of the Invention

This invention relates to a steel framing system for multi-story building structures.

More particularly, the invention concerns an improved framing system for steel-concrete building structures.

In still another respect the invention relates to such framing systems in which seismic loads and bearing loads are transmitted by steel-to-steel contact between structural elements of the load bearing walls.

In yet another and more particular aspect the invention concerns a framing system for multi-story steel-concrete building structures for constructing expandable, inexpensive buildings by the use of semi-skilled or unskilled labor.

In a further and more particular respect the invention pertains to such systems, the use of which permits construction work to proceed without waiting for concrete floor slabs to cure fully.

In yet another and still more particular aspect the invention pertains to framing systems which permit the installation of steel-concrete building structures having improved fire ratings.

2. Description of the Prior Art

In the construction of multi-story buildings such as office buildings, motels and the like, it is common practice to successively erect bearing walls, place steel forms on these walls, pour a concrete floor in the supported forms, erect the bearing walls for the next story, place the forms and pour the next higher floor and so on until the basic structure of the building is completed.

According to one method, the bearing walls are constructed with horizontally spaced steel studs or framing members supported by the floor below with exterior and interior wall facings affixed to these studs as the construction proceeds. According to this method, embods are set into the concrete floors for attaching steel channels which locate the metal studs of the next higher floor and for supporting and for locating other elements of the structure such as exterior curtain walls, lintels and the like.

Although the above-described construction methods offer significant economies in comparison to other methods of building construction, there still exists significant practical and economic problems in the use of such methods. For example, the progress of the construction is slowed by the need to wait until each poured concrete floor develops significant and sufficient strength by curing to permit the floor to support the bearing walls of the next structure and the weight of the next poured floors and walls. Also, the placement of the weldments in the poured floors requires considerable time and expertise to insure that the steel components of the next-upper floor are properly aligned. Furthermore, virtually all construction codes require that the steel elements be shielded by a thermal insulation barrier to achieve a preselected "fire rating", usually expressed as the number of hours of exposure to fire without failure of the structural integrity of the building. This requirement, in turn, dictates that any steel elements used to interconnect the bearing walls and the poured floors be either embedded in concrete or covered by hand-placed insulation materials. These insulation steps further complicate, delay and make the overall construction cost considerably higher as they normally require significant hand labor operations.

It would be highly desirable to provide an improved steel framing system for multi-story building structures in which the time for installation of the building components is reduced, in which the installation can be accomplished by semi-skilled and unskilled labor and in which the use of hand-labor operations to achieve the necessary fire rating is minimized or practically eliminated.

Accordingly, the principal object of the present invention is to provide such an improved framing system for steel-concrete building structures.

A further and more particular object of the invention is to provide such a framing system in which the bearing walls provide for the direct transmission of loads by steel-to-steel contact between the structural elements of the bearing walls, so as to reduce the time delays previously encountered in waiting for each poured concrete floor to cure sufficiently to support the next-above bearing walls and poured floor.

Still another and more particular object of the invention is to provide such an improved framing system for such buildings in which the need for setting weldments in the poured concrete floors is substantially reduced or eliminated.

Still another object of the invention is to provide such framing system which will permit the construction of buildings with the requisite fire rating with a reduced amount of hand labor.

Still another, further and more particular object of the invention is to provide such systems in which the finished building is considerably less expensive, has the desired fire rating and improved seismic load capabilities in comparison to conventional buildings in which such loads are not transmitted by direct steel-to-steel contact of structural elements in the bearing walls.

SUMMARY OF THE INVENTION

These, other and further objects and advantages of the invention will be apparent to those skilled in the art from the following detailed description thereof, taken in conjunction with the drawings, in which:

DESCRIPTION OF THE PREFERRED EMBODIMENTS

Briefly, in accordance with the invention we provide an improved steel framing system for a multi-story building structure, which structures will normally include a poured steel-reinforced concrete floor and load bearing walls which include steel studs on square or rectangular steel tube columns as the principal load bearing elements, to support the floors and walls thereabove.

The improved framing system transmits the entire seismic loads and the bearing loads of the upper walls and floors by steel-to-steel contact between steel structural elements of the walls. These structural elements comprise, in combination, horizontally spaced steel studs or steel tubes having upper and lower ends forming the bearing walls, vertically spaced steel channel members, running along the length of the bearing walls, shaped and dimensioned to receive the upper and lower ends of the steel studs or stud tubes and locating such ends, a steel wide-flange beam, running along the length of the bearing walls at floor level between the spaced channel members and means for securing the steel structural elements together with steel-to-steel contact and for joining said steel elements with said concrete floors to form a unitary building structure in which the entire seismic loads and bearing loads of the upper walls and floors are transmitted by the steel structural elements of the walls therebelow.

The hybrid wide-flange beam includes a lower horizontal flange extending laterally a distance sufficient to support the a outer edges of the steel-reinforced concrete floor deck which abuts the side walls between the channel members, an upper horizontal flange to support the channel member thereabove and a web conecting the upper and lower flanges.

Figure 1:
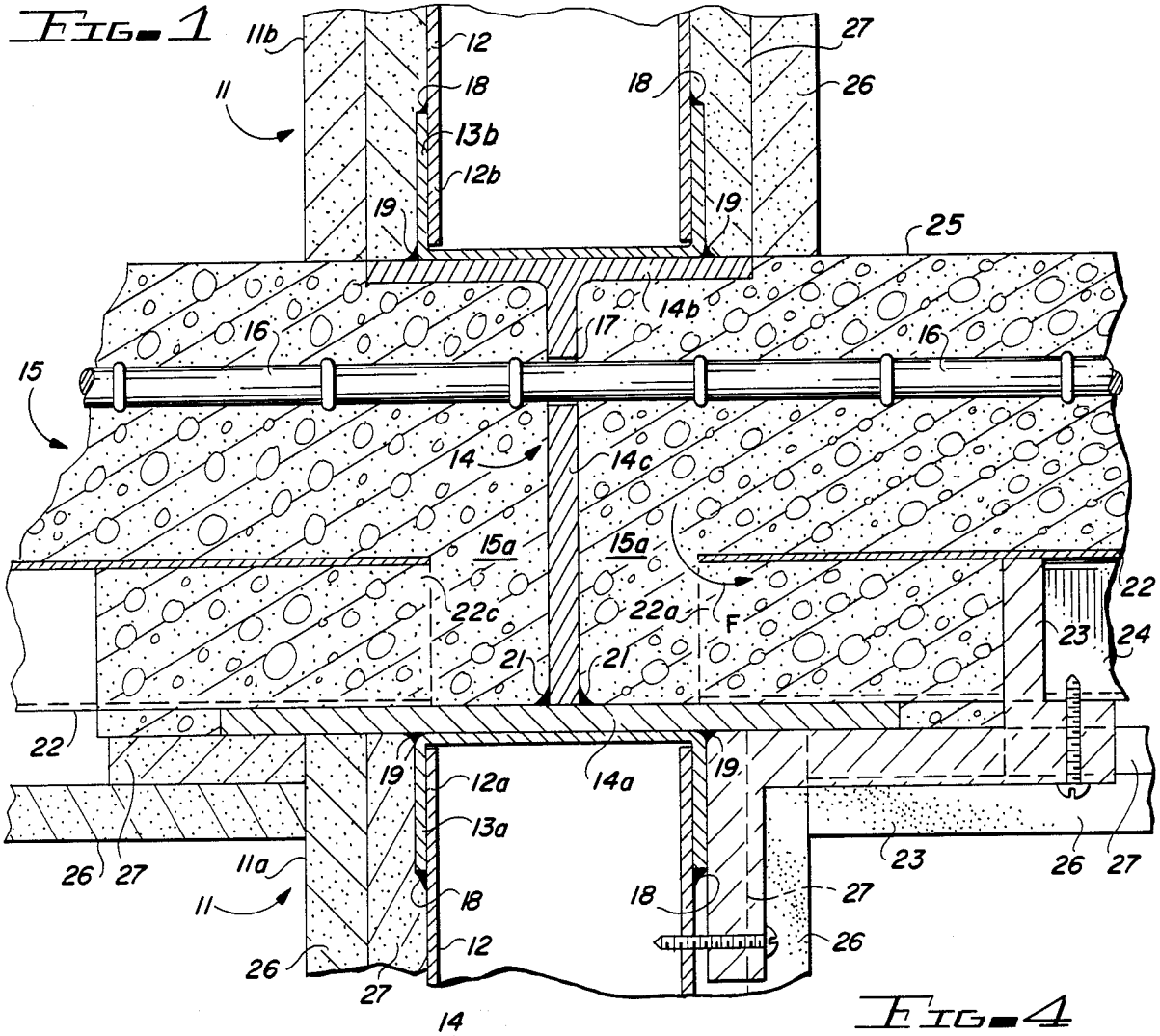
FIG. 1 is a cross-section of the joint between an interior bearing wall and a poured concrete floor of a building constructed in accordance with the principles of the present invention.

Turning now to the drawings, FIG. 1 depicts a cross-section of a typical joint between an interior bearing wall and a poured concrete floor. The bearing wall, generally indicated by reference numeral 11 consists of a wall 11*a* of a lower story of the building and a wall 11*b* of the next higher story of the building. The wall 11 is formed of horizontally spaced steel studs 12, the upper ends 12*a* and the lower ends 12*b* of which are received in and located by channels 13*a* and 13*b*, respectively.

A hybrid wide flange beam, generally indicated by reference numeral 14, supports the wall 11 and the poured concrete floor generally indicated by reference numeral 15. The hybrid beam 14 includes a lower horizontal flange 14*a*, an upper horizontal flange 14*b* and a web 14*c*. The lower flange 14*a* extends laterally a distance sufficient to support the inner ends 15*a* of the poured concrete floor 15. The upper horizontal flange 14*b* directly supports the upper channel member 13*b*. The web 14*c* of the beam 14 directly transmits the vertical loads of the upper walls 11*b* and upper floors (not shown) to the upper end 12*a* of the studs 12 of walls 11*a* located below the beam 14 and next successive lower floors.

As will be observed, all vertical loads of the building, as well as lateral loads, (e.g., seismic loads), are directly transmitted by steel-to-steel contact of the structural elements of the bearing wall 11 (consisting of the studs 12, the channels 13 and the beam 14. Inner ends 15*a* of the poured concrete floor 15 are secured to each other and to the steel-to-steel load transmitting wall structures 11–14 by means of rebar 16 extending through holes 17 in the web 14*c* of the beam 14. The studs 12, channels 13 and beam 14 can be secured together by any convenient fastening technique to form a unitary structure. For example, the studs 12 can be secured to the channels 13 by welds 18 and the channels 13 can, in turn, be secured to the flanges of the beam 14 by means of stitch welds 19.

In the presently preferred embodiment of the invention the beam 14 is formed by welding a T-shape (forming the upper flange 14*b* and web 14*c*) to a plate forming the lower flange 14*a*, as indicated by the fillet welds 21.

In constructing a composite steel-concrete structure according to the present invention, the preferred sequence of assembly is as follows:

First, the studs 12 of a lower story of the structure are located in a bottom channel (not shown) and the upper ends 12*a* are located as shown in the upper channel 13*a*. The plate forming the lower flange 14*a* is then stitch welded to the upper channel 13*a* and the T-shape forming the upper flange 14*b* and web 14*c* is then welded to the lower flange 14*a* as shown by the fillet welds 21. The rebar 16 is then located through the holes 17 in the webs 14*c* of adjacent beams 14. Metal deck forms 22 are then placed to span the spaces between adjacent bearing walls 11 with the inner ends 22*a* of the deck forms 22 resting on and supported by the lower flange 14*a* of the beam 14. Temporary pour stops 23 (indicated by dashed lines), fabricated of wood or other suitable material are then placed so as to extend upwardly into the flutes 24 of the metal deck forms 22, forming a temporary closure of the flutes 24. These temporary closures permit plastic concrete to be poured into the deck forms 22 and allows the plastic concrete to flow as indicated by the arrow F into the inner ends of the flutes 24. After the plastic concrete has hardened the temporary stops 23 are removed. In fashion, the hardened concrete in the area of the flute 24 forms an effective fire protection for the inner portions of the beam 14.

As soon as the plastic concrete hardens sufficiently to permit workers to access the deck surface 25, channel 13*b* is welded to the upper flange 14*b* of the beam 14 and erection of the metal components of the wall 11*b* for the next floor above can commence, without waiting for the concrete floor 15 to cure further and develop sufficient structural strength to support all of the weight of the structure above it. Fire protection for the metal studs 12 and the outer surfaces of the flanges 14*a* and 14*b* is provided by appropriately-rated drywall layers 26 and 27 affixed to the studs 12 and to the undersurface of the concrete floor 15.

Figure 2:
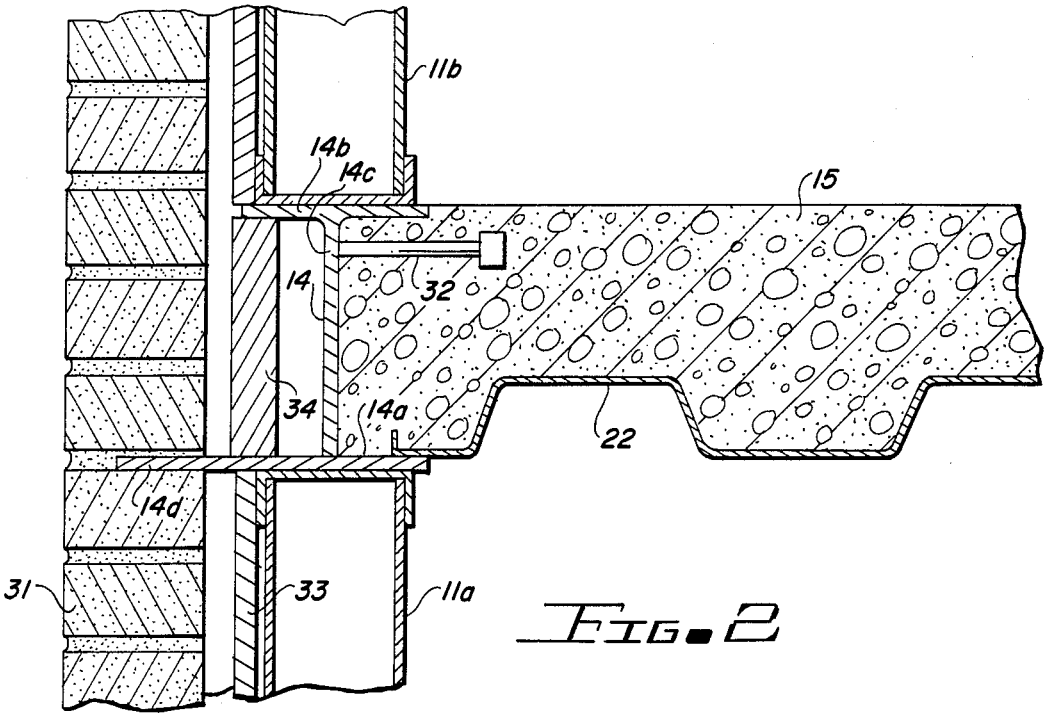
FIG. 2 is a cross-sectional view of a typical brick-faced curtain wall of a building constructed in accordance with the present invention.

FIG. 2 illustrates a joint between an upper side wall 11*b* and a lower side wall 11*a* of a typical exterior wall of a building constructed in accordance with the invention. In FIG. 2 the exterior wall includes a brick curtain wall 31, the courses of which are supported at each floor level by an outward extension 14*c* of the bottom flange 14*a* of the hybrid beam 14. The poured concrete floor 15 and hybrid beam 14 are secured together by means of spaced anchors 32 welded to the web 14*c* of the hybrid beam 14 prior to pouring the floor 15. The layers of drywall insulation 26 and 27 of FIG. 1 have been omitted for clarity of illustration but FIG. 2 does depict a layer of exterior fire-rated sheathing 33 affixed to the outer side of walls 11*a* and 11*b* for fire proofing purposes. A tie bar 34 is welded between the upper flange 14*b* and the lower flange 14*a* to improve the load carrying capability of the beam 14 which carries the weight of the upper structure as in FIG. 1 and the weight of the curtain wall 31.

Figure 3:
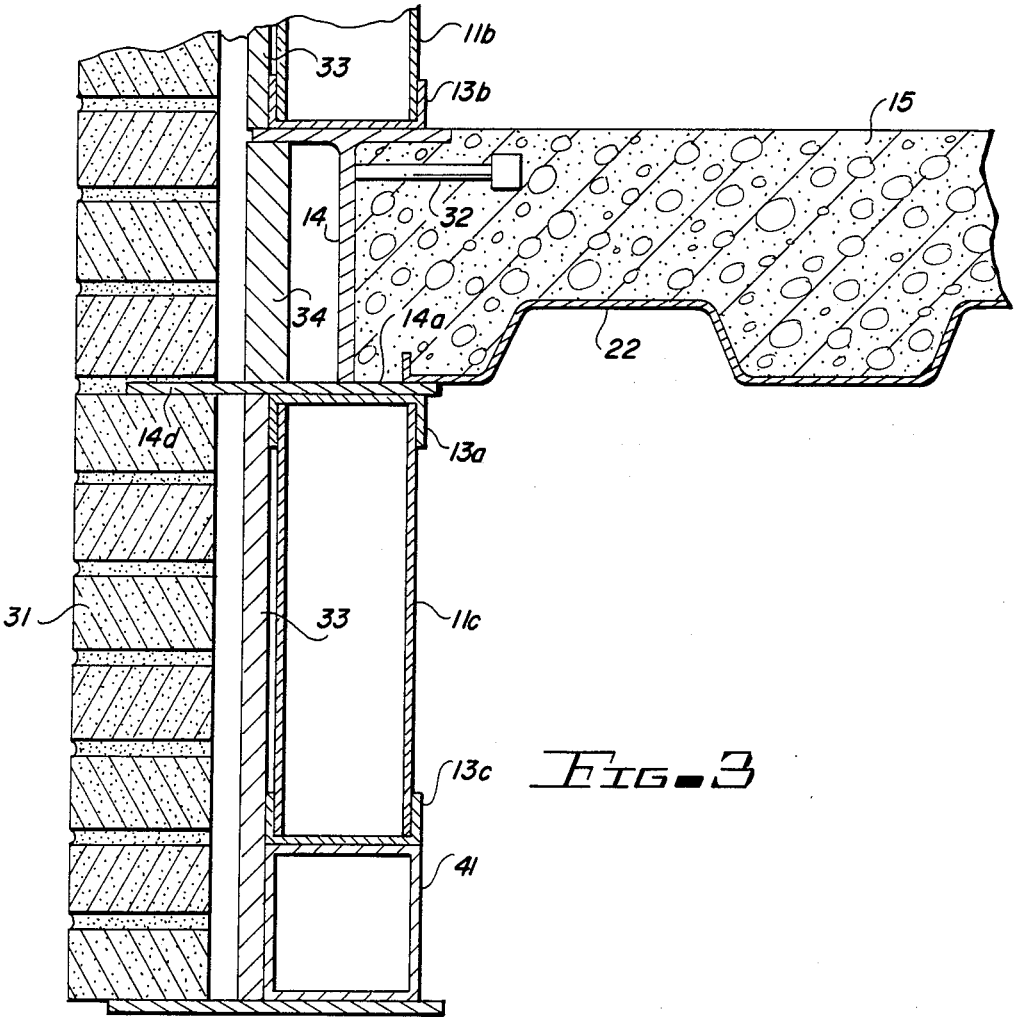
FIG. 3 is a cross-sectional view of a typical brick-faced curtain wall of a building constructed in accordance with the invention showing the typical placement of a lintel.

FIG. 3 is a sectional view of a typical exterior wall of a building constructed in accordance with the invention, which has a brick veneer wall 31, showing the placement of a lintel for a door or window.

Although the details can be varied to suit the particular exterior of the building, etc., in accordance with the presently preferred embodiment of the invention, chosen for the purposes of illustration, the heading consists of an upper channel or track 13*a* which carries shortened studs 11*c*, the bottom ends of which are located in a lower track 13*c*. A box beam 41 (typical) or other structural member is welded to the underside of the lower track 13*c* and serves as the lintel. To support a brick veneer exterior wall or curtain, a brick flange 42 is welded to the underside of the lintel 41.

Figure 4:
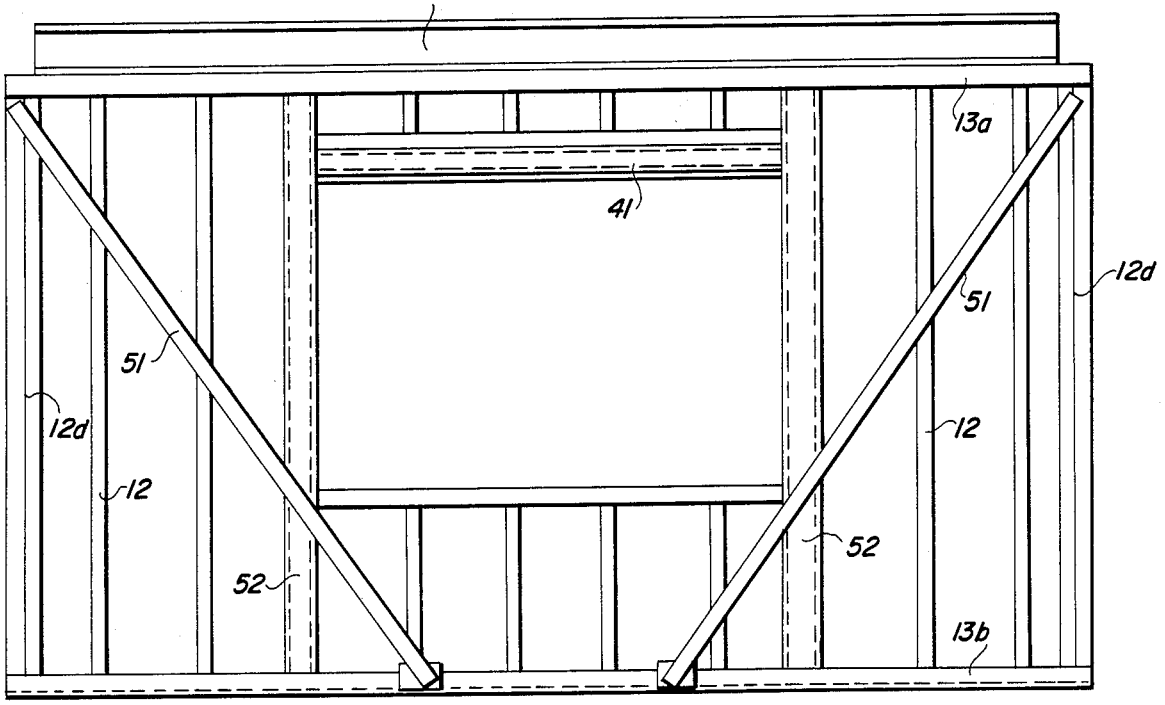
FIG. 4 is an elevation of a typical exterior wall of a building constructed in accordance with the invention with a window therein.

FIG. 4 illustrates the relationship of the steel elements of a typical wall having a window opening, constructed in accordance with one presently preferred embodiment of the invention. Upper and lower channels or "tracks" 13*a* and 13*b* locate spaced steel studs 12. The hybrid beam 14 is carried on the upper track 13*a*. Double studs, box beams or other structural members 12*d* are provided at the location of intersecting bearing walls. Diagonal brace straps 51 are welded at the locations of the double studs 12*d*, spaced studs 12, lintel support columns 52 and lower channel 13*b*.

Having described our invention in such terms as to enable those skilled in the art to understand and practice it and, having identified various presently preferred embodiments thereof which are chosen for purposes of illustration and not by way of limitation on the scope of the invention, we claim:

1. In a multi-story building structure having a lower floor and at least one upper floor, including poured steel-reinforced concrete floors, and load bearing walls, including upper walls, including steel studs, supporting the upper floors and transmitting seismic and bearing loads therebetween, the improved framing system for transmitting the entire seismic loads and the entire bearing loads of the upper walls and floors by steel structural elements of the walls therebelow, said steel structural elements comprising, in combination:

(a) horizontally spaced steel studs, having upper and lower ends, forming said walls;

(b) vertically spaced steel channel members running along the entire length of said walls at floor and ceiling level, shaped and dimensioned to receive and locate the upper and lower ends of said steel studs to directly transmit said loads from said studs to a hybrid wide-flange steel beam, each of said channel members having a U-shaped cross-section, including a horizontal web in steel-to-steel contact with said beam and continuous side flange portions extending perpendicular to said beam;

(c) the hybrid wide-flange steel beam running along the length of said walls at floor level between said spaced channel members, said hybrid beam including (i) a lower horizontal flange extending laterally a distance sufficient to support outer edges of said steel-reinforced concrete floor which abuts the side walls between said channel members, (ii) an upper horizontal flange to support said channel member thereabove, and (iii) a web connecting said upper and lower flanges; and (d) means for securing said steel structural elements together with steel-to-steel contact and for joining said secured steel elements and said concrete floors to form a unitary building structure in which the entire seismic loads and bearing loads of the upper walls and floors are transmitted by said steel structural elements of the walls therebelow.

* * * * *